US009826606B2

(12) United States Patent
Feng et al.

(10) Patent No.: US 9,826,606 B2
(45) Date of Patent: Nov. 21, 2017

(54) CLOUD-BASED MULTI-CHANNEL STAGE LIGHT ADJUSTMENT SYSTEM TECHNICAL FIELD

(71) Applicant: ZHEJIANG DAFENG INDUSTRY CO., LTD., Yuyao, Zhejiang Province (CN)

(72) Inventors: Hua Feng, Yuyao (CN); Huafeng Yan, Yuyao (CN); Lifeng Wu, Yuyao (CN); Zhen Liu, Yuyao (CN); Zhengping Wu, Yuyao (CN); Haoxiang Xu, Yuyao (CN)

(73) Assignee: Zhejiang Dafeng Industry Co. Ltd. (CN)

( * ) Notice: Subject to any disclaimer, the term of this patent is extended or adjusted under 35 U.S.C. 154(b) by 0 days.

(21) Appl. No.: 15/229,309

(22) Filed: Aug. 5, 2016

(65) Prior Publication Data

US 2017/0042000 A1 Feb. 9, 2017

(30) Foreign Application Priority Data

Aug. 7, 2015 (CN) ..... 2015 1 0483105
Aug. 7, 2015 (CN) ..... 2015 2 0593432 U

(51) Int. Cl.
*H05B 37/02* (2006.01)

(52) U.S. Cl.
CPC ..... *H05B 37/029* (2013.01); *H05B 37/0272* (2013.01)

(58) Field of Classification Search
CPC ..... H05B 37/0272; H05B 37/029
See application file for complete search history.

(56) References Cited

U.S. PATENT DOCUMENTS 9,253,857 B2 * 2/2016 Van Der Werff .. H05B 37/0245
2008/0265799 A1 * 10/2008 Sibert ..... H05B 37/0245 315/292
2010/0259931 A1 * 10/2010 Chemel ..... F21V 17/02 362/249.02
2010/0301776 A1 * 12/2010 Feri ..... H05B 37/029 315/312
2013/0290001 A1 * 10/2013 Yun ..... G10L 15/00 704/275
2014/0062297 A1 * 3/2014 Bora ..... H05B 33/0863 315/34
2015/0002047 A1 * 1/2015 Sun ..... H05B 37/0272 315/294
2015/0069916 A1 * 3/2015 Fleming ..... H05B 37/029 315/131

(Continued)

*Primary Examiner* — Jason M Crawford
(74) *Attorney, Agent, or Firm* — Tarolli, Sundheim, Covell & Tummino LLP

(57) ABSTRACT

The cloud-based multi-channel stage light adjustment system of the present patent application includes a cloud-based control center, an encoding and modulation unit, a ZIGBEE transceiving unit, a proximal end lighting regulation unit and the stage lighting sets. The cloud-based control center further comprises an interference reduce and light adjustment unit, a scenario generation unit and an instruction switching unit, achieves a multi-channel control of stage light adjustment, greatly reduces the interference with other stage systems, while adopts the multi-point transceiving model which is based on ZIGBEE to improve the transmission efficiency of regulation.

5 Claims, 3 Drawing Sheets

(56) References Cited

U.S. PATENT DOCUMENTS

| | | | | |
|---|---|---|---|---|
| 2015/0084513 | A1* | 3/2015 | Anthony | H05B 37/0245 315/131 |
| 2015/0257230 | A1* | 9/2015 | Lee | H05B 33/0851 315/186 |
| 2016/0050723 | A1* | 2/2016 | Gochnauer | H05B 33/086 315/151 |

* cited by examiner

CLOUD-BASED MULTI-CHANNEL STAGE LIGHT ADJUSTMENT SYSTEM TECHNICAL FIELD

TECHNICAL FIELD

The present patent application relates to a stage control, and more particularly, to a cloud-based multi-channel stage light adjustment system.

BACKGROUND

The existing stage lighting systems typically include a plurality of lighting units. In order to achieve the predetermined lighting effects, each lighting unit need to be regulated. The existing regulation methods are mostly based on manual adjustment, which result in a low efficiency. But since stage lighting system is a systematic engineering, each set of lighting units can affect each other, so it is difficult for engineers to predict what the effect will be of the adjusted lighting unit on the other sets of lighting units. Therefore it can only be estimated by experience, furthermore the engineers cannot predict whether or not some set of the adjusted lighting units can interfere with other stage systems, for example, the sound system.

Secondly, since a serious interference exists on live performance of stage, it should be considered that how to ensure each lighting unit can receive an instruction from the cloud-based control center accurately.

SUMMARY

The purpose of the present patent application is achieved by the following technical solution.

According to the embodiment of the present patent application, it provides a cloud-based multi-channel stage light adjustment system. The system includes a cloud-based control center, an encoding and modulation unit, a ZIGBEE transceiving unit, a proximal end lighting regulation unit and stage lighting sets. Wherein:

The cloud-based control center is configured to generate a stage lighting regulation instruction and a scenarios control instruction.

The encoding and modulation unit is configured to encode and modulate the stage lighting regulation instruction and the scenarios control instruction, and transmits the encoded and modulated data to the stage lighting sets with the ZIGBEE transceiving unit.

The ZIGBEE transceiver unit is connected to the cloud-based control center, and transfers the lighting regulation instruction and the scenarios control instruction to the stage lighting sets, according to a high-speed wireless transmission protocol. And The proximal end lighting regulation unit is connected to the cloud-based control center, and corresponds to the stage lighting sets. The proximal end lighting regulation unit is configured to receive the lighting regulation instruction and the scenarios control instruction so as to drive the stage lighting sets.

According to the embodiment of the present patent application, the cloud-based control center includes an interference reduce and light adjustment unit. The interference reduce and light adjustment unit includes a plurality of channel sets. Each of the channel sets corresponds to one of the stage lighting sets and includes a plurality of channels. The channel corresponds to the lighting regulation parameter. The interference reduce and light adjustment unit is configured to regulate the value of the lighting regulation parameter of the channel. The interference reduce and light adjustment unit determines whether or not the channel sets are multi-selected to regulate the lighting regulation parameters of the multi-selected channel sets synchronously or regulate the lighting regulation parameters of each channel set respectively.

According to the embodiment of the present patent application, the cloud-based control center also includes a scenario generation unit. The scenario generation unit is configured to determine whether at least one scenarios parameter corresponding to a plurality of scenarios points exists to decide to wait for the generated scenarios parameter to be sent the scenarios points or store the regulated lighting regulation parameters to the scenarios points. Furthermore, the scenario generation unit can cascade the lighting regulation parameters to generate each scenarios parameter.

According to the embodiment of the present patent application, the cloud-based control center also includes an instruction switching unit. According to a lighting regulation standard protocol, the instruction switching unit switches the lighting regulation parameters and the scenarios parameters to generate a plurality of lighting regulation instructions and a plurality of the scenarios control instructions of the channel set. According to the lighting regulation standard protocol, the instruction switching unit switches the preprogrammed adjustment parameters to generate a programmed control instruction. And according to the high-speed wireless transmission protocol, the ZIGBEE transceiving unit transfers the programmed control instruction to the stage lighting sets so as to adjust the lighting effect of the stage lighting sets.

According to the embodiment of the present patent application, the interference reduce and light adjustment unit specifically includes: a data receiving unit, a micro processing unit, a pulse width modulation unit, an insulated gate driver protection unit, an insulated gate voltage adjustment unit and a filter unit. The data receiving unit receives the light adjustment signal, then transmits the signal to the micro processing unit. The pulse width modulation unit is electrically connected to the output of the micro processing unit. The output of the micro processing unit is electrically connected to the input of the insulated gate driver protection unit. The output of the insulated gate driver protection unit is electrically connected to the input of the insulated gate voltage adjustment unit. The insulated gate voltage adjustment unit is electrically connected to the input of the filter unit. The output of the filter unit is electrically connected to the stage lighting sets.

The instruction verification unit is configured to perform the accuracy detection of the signal from a second ZIGBEE transceiving unit. If difference between the signal and the control signal which is sent previously exists, the instruction verification unit can send an error signal to the cloud-based control center.

The cloud-based multi-channel stage light adjustment system of the present patent application includes a cloud-based control center, an encoding and modulation unit, a ZIGBEE transceiving unit, a proximal end lighting regulation unit and stage lighting sets. The cloud-based control center also includes an interference reduce and light adjustment unit, a scenarios generation unit and an instruction switching unit to achieve multi-channel control of stage light adjustment and greatly reduces interference with other stage system. While the cloud-based stage multi-channel light adjustment system adopts the multi-point transceiving model based on ZIGBEE to improve the transmission efficiency of regulation.

BRIEF DESCRIPTION OF THE DRAWINGS

By reading the following detailed description of preferred embodiments below, a variety of other advantages and benefits will become clear to those of ordinary skill in the art. The drawings are only for illustrating the purpose of the preferred embodiment, and should not be considered as a limitation on the present patent application. And throughout the drawings, like parts may be referred to by like numerals, in which.

DETAILED DESCRIPTION

Below with reference to the drawings, the exemplary embodiment of the present disclosure is described in more detail. Although the drawings show the exemplary embodiments of the present disclosure, However, it should be considered that the present disclosure may be implemented in various forms and should not be limited to the embodiments illustrated herein. Rather, these embodiments are enable person to understand the present disclosure more thoroughly, and can completely convey the scope of the disclosure to those skilled in the art.

Figure 1:
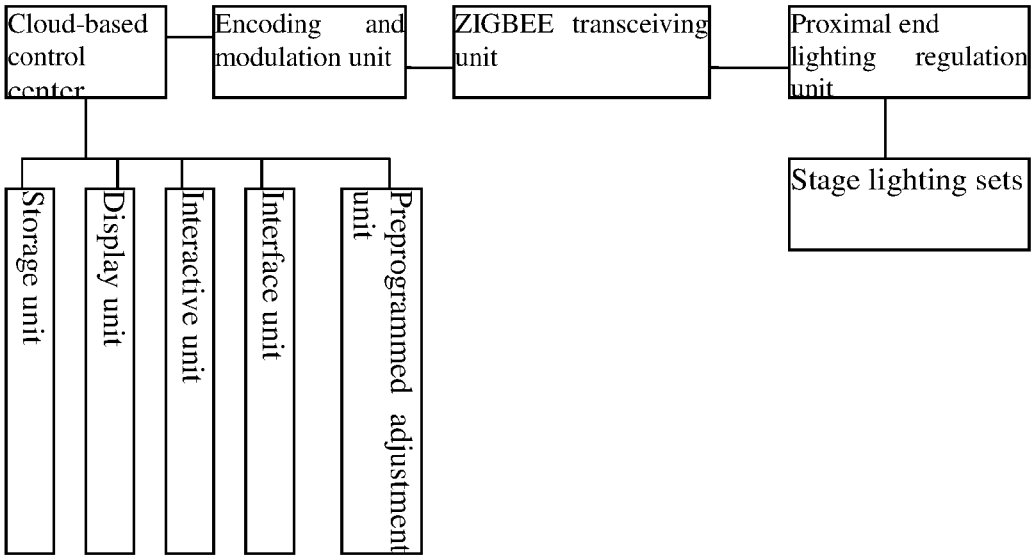
FIG. 1 illustrates a structure schematic of a cloud-base multi-channel stage light adjustment system, according to an embodiment of the present patent application.

According to the embodiment of the present patent application, it provides a cloud-based multi-channel stage light adjustment system. As shown in FIG. 1, the system includes a cloud-based control center, an encoding and modulation unit, a ZIGBEE transceiving unit, a storage unit, a display unit, an interactive unit, an interface unit, a preprogrammed adjustment unit, a proximal end lighting regulation unit and stage lighting sets. Wherein, The cloud-based control center is configured to generate a stage lighting regulation instruction and a scenarios control instruction.

The encoding and modulation unit is configured to encode and modulate the stage lighting regulation instruction and the scenarios control instruction, and transmits the encoded and modulated data to the stage lighting sets with the ZIGBEE transceiving unit.

The ZIGBEE transceiving unit is connected to the cloud-based control center, and transfers the stage lighting regulation instruction and the scenarios control instruction to the stage lighting sets, according to a high-speed wireless transmission protocol.

The storage unit is connected to the cloud-based control center and is configured to store lighting regulation parameters and scenarios parameters.

The display unit is connected to the cloud-based control center, and is configured to display the lighting regulation parameters of the lighting regulation instruction and the scenarios parameters of the scenarios control instruction.

The interactive unit is connected to the cloud-based control center, and is configured to adjust the execution time of the scenarios parameters to finish adding the scenarios parameters to the preprogrammed adjustment parameters so that the scenarios generation unit of the cloud-based control center can switch between the storage state and cut-in state of the scenarios The interface unit is connected to the cloud-based control center, and is configured to update the control program of the cloud-based control center and correct the control parameters of the cloud-based control center.

The preprogrammed adjustment unit is connected to the cloud-based control center, and is configured to cascade multi-set scenarios parameters to create various lighting converting effects. The preprogrammed adjustment unit determines whether a scenarios point stores a scenarios parameter to decide to generate a preprogrammed adjustment parameter or maintain at preprogrammed adjustment state until it stores the scenarios parameters. And The proximal end lighting regulation unit is connected to the cloud-based control center, and corresponds to the stage lighting sets, configured to receive the lighting regulation instruction and the scenarios control instruction so as to drive the stage lighting sets.

Figure 2:
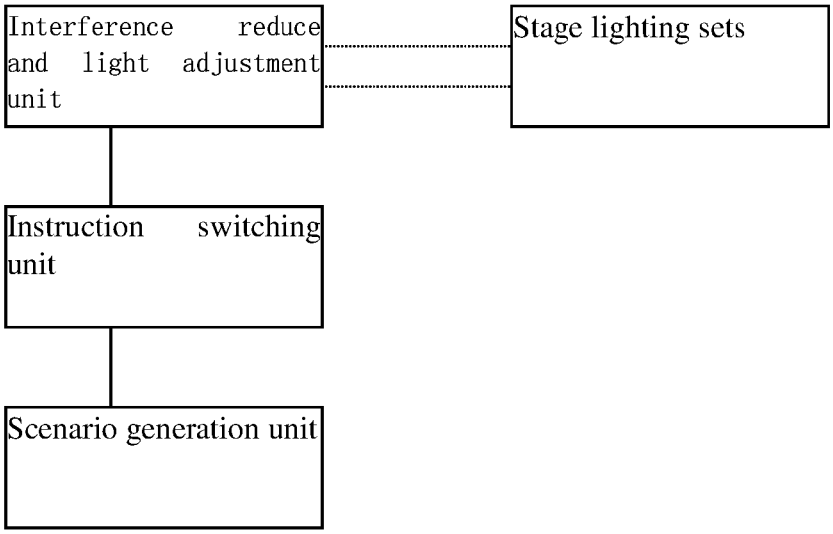
FIG. 2 illustrates a structure schematic of a cloud-based control center, according to an embodiment of the present patent application.

According to the embodiment of the present patent application, as shown in FIG. 2, the cloud-based control center specifically includes an interference reduce and light adjustment unit, a scenario generation unit and an instruction switching unit, wherein, The interference reduce and light adjustment unit includes a plurality of channel sets. Each of the channel sets corresponds to one of the stage lighting sets and includes plurality of channels. The channels corresponds to lighting regulation parameters. The interference reduce and light adjustment unit is configured to adjust the value of the lighting regulation parameters of the channels. The interference reduce and light adjustment unit determines whether multi-channels are selected to decide regulate the lighting regulation parameters of the multi-selected channels synchronously or regulate the lighting regulation parameters of different channel sets respectively.

The scenario generation unit is configured to determine whether multiple scenarios points correspond to at least one scenarios parameter so as to decide to wait for the generated scenarios parameter to be sent to the scenarios point or store the regulated lighting regulation parameter into the scenarios point. Furthermore, the scenario generation unit cascades the lighting regulation parameters to generate each scenarios parameter.

The instruction switching unit is configured to switch the lighting regulation parameters and the scenarios parameters according to the lighting regulation standard protocol to generate a plurality of lighting regulation instructions and a plurality of scenarios regulation instructions of the channel set. The instruction switching unit is configured to switch the preprogrammed regulation parameters according to the lighting regulation standard protocol to generate one programmed control instruction. And the ZIGBEE transceiving unit transmits the programmed control instruction to the stage lighting sets according to the high-speed wireless transmission protocol so as to adjust the lighting effect of the stage lighting sets.

Figure 3:
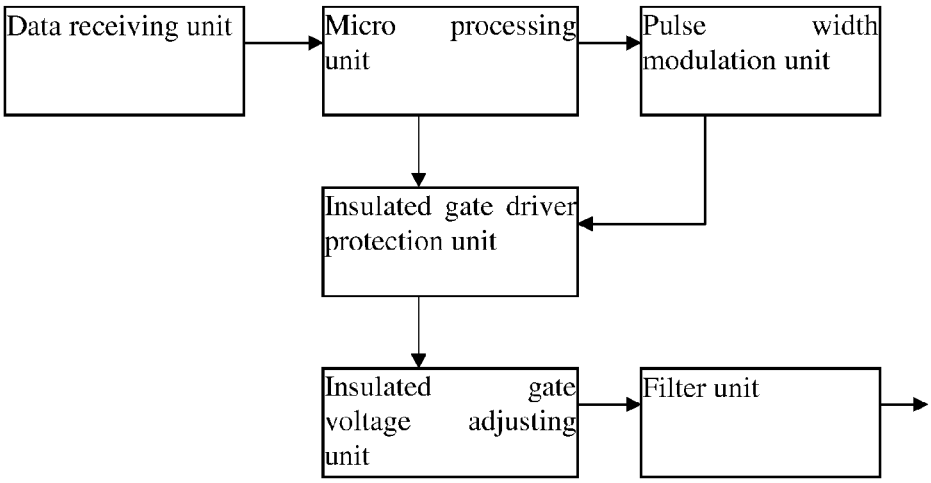
FIG. 3 illustrates a structure schematic of an interference reduce and light adjustment unit, according to an embodiment of the present patent application.

According to the embodiment of the present patent application, as shown in FIG. 3, the interference reduce and light adjustment unit specifically includes: a data receiving unit, a micro processing unit, a pulse width modulation unit, an insulated gate driver protection unit, an insulated gate voltage adjustment unit and a filter unit. The data receiving unit receives the light adjustment signal, and transmits the signal to the micro processing unit. The pulse width modulation unit is electrically connected to the output of the micro processing unit. The output of the micro processing unit is electrically connected to the input of the insulated gate driver protection unit. The output of the insulated gate driver protection unit is electrically connected to the input of the insulated gate voltage adjustment unit. The insulated gate voltage adjustment unit is electrically connected to the input of the filter unit. The output of the filter unit is electrically connected to the stage lighting sets.

Figure 4:
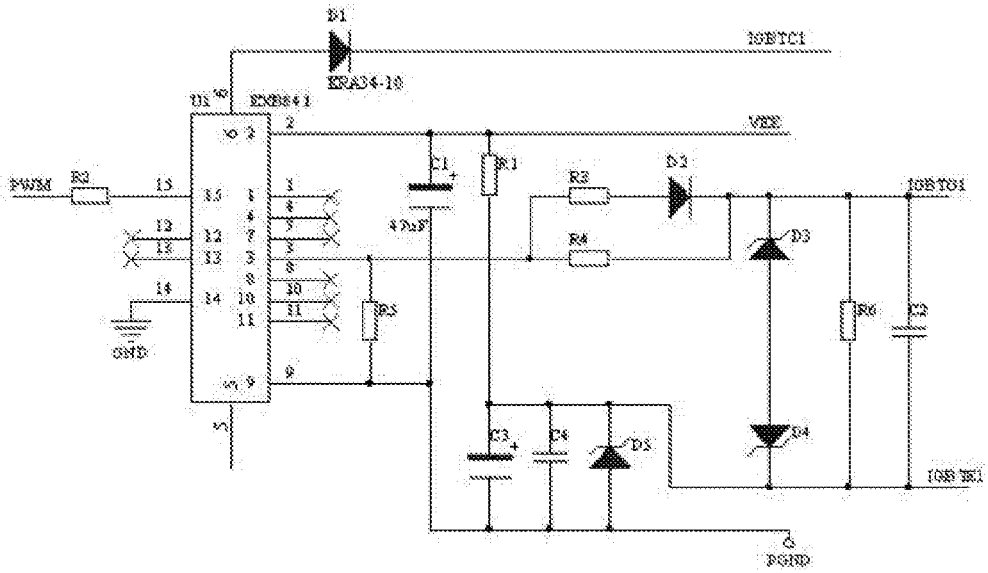
FIG. 4 illustrates a schematic diagram of the circuit component of the insulated gate driver protection unit, according to an embodiment of the present patent application.

According to the preferred embodiment of the present patent application, as shown in FIG. 4, the insulated gate drive protection unit includes a driving chip, a diode D2, a voltage regulator diode D3, a voltage regulator diode D4 and a voltage regulator diode D5. The overcurrent protection end of the driver chip EXB841 is connected with the collector of the insulated gate in series. Resistor R3 and diode D2 is connected between the driving output of the driving chip and the gate of the insulated gate in series. The anode of the diode D2 is connected with the resistor R3 in series. One end of the resistor R4 is electrically connected to the cathode of the diode D2. The other end of the resistor R4 is electrically connected to the driving output of the driving chip. Resistor R1 is connected between the power supply end of the driving chip and the emitter of the insulated gate in series. The voltage regulator diode D3 and the voltage regulator diode D4 is connected between the gate of the insulated gate and the emitter of the insulated gate in series. The cathode of the voltage regulator diode D3 is electrically connected to the gate of the insulated gate. The anode of the voltage regulator diode D3 is electrically connected to the anode of the voltage regulator diode D4. The cathode of the voltage regulator diode D4 is electrically connected to the emitter of the insulated gate. The Resistor R6 is connects to capacitor C2 in parallel. And the capacitor R6 is electrically connected between the gate of the insulated gate and the emitter of the insulated gate.

Figure 5:
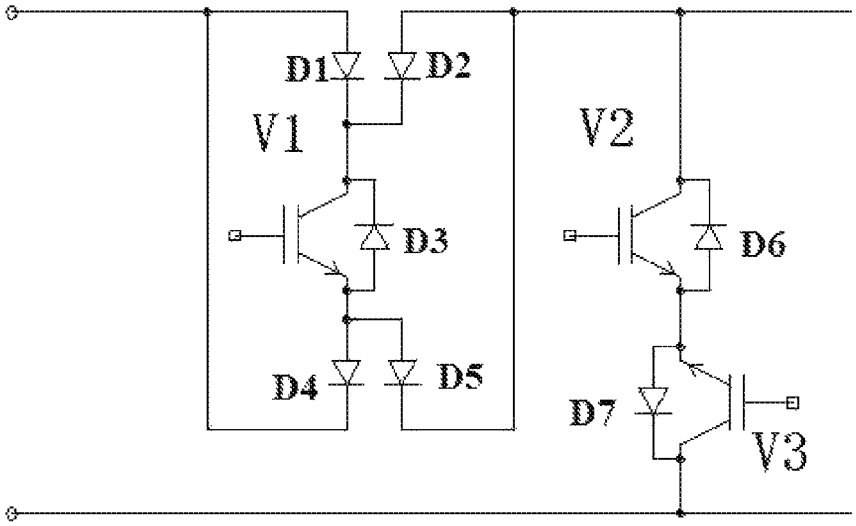
FIG. 5 illustrates a schematic diagram of the circuit component of the insulated gate voltage adjustment unit, according to an embodiment of the present patent application.

According to the embodiment of the present patent application, as shown in FIG. 5, the insulated gate voltage regulation unit includes an insulated gate bipolar transistor V1, an insulated gate bipolar transistor V2 and an insulated gate bipolar transistor V3. The collectors and the emitters of the insulated gate bipolar transistor V1, the insulated gate bipolar transistor V2 and the insulated gate bipolar transistor V3 are all connected with a diode D3, a diode D6 and a diode D7. Each anode of the diode D3, the diode D6 and the diode D7 is electrically connected to each emitter of the insulated gate bipolar transistor V1, the insulated gate bipolar transistor V2 and the insulated gate bipolar transistor V3 respectively. The collector of the insulated gate bipolar transistor V1 is connected with the cathode of the diode D2 in series. The anode of the diode D2 is connected to the collector of the insulated gate bipolar transistor V2 in series. The emitter of the insulated gate bipolar transistor V2 is connected with the emitter of the insulated gate bipolar transistor V3 in series. The emitter of the insulated gate bipolar transistor V1 is connected with the anode of the diode D5 in series. The cathode of the diode D5 is connected to the collector of the emitter of the insulated gate bipolar transistor V2 in series.

According to the embodiment of the present patent application, the interface unit causes the scenario generation unit to switch between the scenario storage state and the scenario cut-in state, specially including:

When in the scenario storage state, the scenario generation unit determines whether a scenario parameter at the scenario point exists. When a scenario parameter exists, the scenario generation unit maintains in the scenario storage state. When a scenario parameter does not exist, it stores the regulated lighting regulation parameters of the channel set to the scenario point.

When in the scenario cut-in state, the scenario generation unit determines whether there exists a scenario parameter at the scenario point. When there exists a scenario parameter, the scenario generation unit cuts in the scenario parameter from the storage unit to the scenario point. When there does not exit a scenario parameter, the scenario generation unit maintains in the scenario cut-in state until there exists a scenario parameter.

According to the embodiment of the present patent application, the preprogrammed regulation unit determines whether the remaining operating time of the preprogrammed regulation parameter is more than a predetermined time. When more than the predetermined time, the preprogrammed regulation unit adds the scenario parameter to the preprogrammed regulation parameter. When less than the predetermined time, the preprogrammed regulation unit maintains in the preprogrammed adjustment state.

Figure 6:
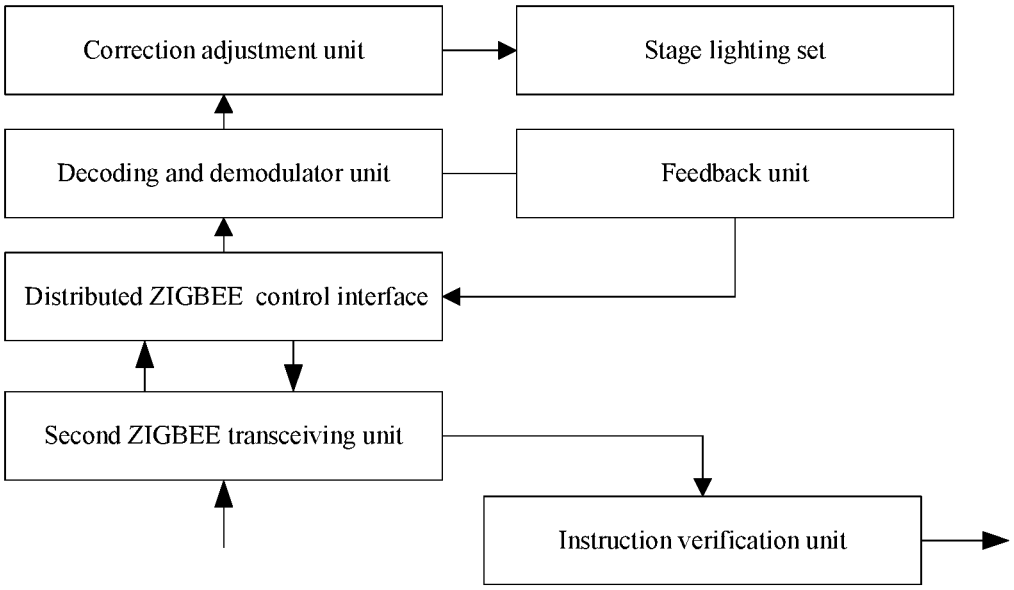
FIG. 6 illustrates a schematic diagram of the proximal end lighting regulation unit, according to an embodiment of the present patent application.

According to the embodiment of the present patent application, as shown in FIG. 6, the proximal end lighting regulation unit includes: a second ZIGBEE transceiving unit, an instruction verification unit, a distributed ZIGBEE control interface, a decoding demodulator unit, a feedback unit and a correction adjustment unit. The instruction verification unit is connected to the second ZIGBEE transceiving unit and the cloud-base control center respectively.

The decoding demodulation unit is configured to decode and demodulate the control signal of the distributed ZIGBEE control interface, then transmits the decoded and demodulated signal to the correction adjustment unit and the feedback unit respectively.

The correction adjustment unit processes data and drives LED light sets based on the received signal which is corrected by simulation.

The feedback unit is configured to return the decoded and demodulated signal to the second ZIGBEE transceiving unit with the distributed ZIGBEE control interface.

The instruction verification unit is configured to carry out the accuracy detection of the returned signal from the second ZIGBEE transceiving unit. When the instruction verification unit detects the difference with the control signal which is sent previously, an error signal is sent to the cloud-based control center.

The above is only the preferred embodiment of the present patent application, but the scope of the present patent application is not limited therein, and within the scope of the present patent application disclosed in the present patent application, all the changes and replacements which any skilled in the art can be easily think of should fall within the scope of the present patent application. Accordingly, the scope of the present patent applications is defined by reference to the claims.

What is claimed is:

1. A cloud-based multi-channel stage light adjustment system, comprising:

a cloud-based control center, an encoding and modulation unit, a ZIGBEE transceiving unit, a proximal end lighting regulation unit; and stage lighting sets, wherein the cloud-based control center is configured to generate a stage lighting regulation instruction and a scenario control instruction;

the encoding and modulation unit is configured to encode and modulate the stage lighting regulation instruction and the scenario control instruction, and transmits encoded and modulated data to the stage lighting sets with the ZIGBEE transceiving unit;

the ZIGBEE transceiving unit is connected to the cloud-based control center, and transmits the lighting regulation instruction and the scenario control instruction to the stage lighting sets, according to a high-speed wireless transmission protocol; and the proximal end lighting regulation unit is connected to the cloud-based control center, and corresponds to the stage lighting sets, configured to receive the lighting regulation instruction and the scenario control instruction to drive the stage lighting sets.

2. The system according to claim 1, wherein the cloud-based control center comprises an interference reduce and light adjustment unit, the interference reduce and light adjustment unit comprises a plurality of channel sets, each of the channel sets corresponds to one of the stage lighting sets and has a plurality of channels, the channel corresponds to lighting regulation parameter, the interference reduce and light adjustment unit is configured to adjust a value of the lighting regulation parameter of the channel; the interference reduce and light adjustment unit determines whether a plurality of the channel sets are selected to decide to regulate lighting regulation parameters of the multi-selected channel sets synchronously or regulate the lighting regulation parameters of different channel sets respectively.

3. The system according to claim 2, wherein the cloud-based control center further comprises a scenario generation unit, the scenario generation unit is configured to determine whether at least one scenario parameter corresponding a plurality of scenario point exits to decide to wait for the generated scenario parameter to be sent to the scenario point or store the regulated lighting regulation parameter to the scenario point, and the scenario generation unit cascades the lighting regulation parameters to generate each of the scenario parameters.

4. The system according to claim 3, wherein the cloud-based control center further comprises an instruction switching unit, the instruction switching unit switches the lighting regulation parameter and the scenario parameter, according to a standard lighting regulation protocol to generate a plurality of lighting regulation instructions of the channel set and a plurality of scenario control instructions; the instruction switching unit switches the preprogrammed adjustment parameters, according to the standard lighting regulation protocol to generate one programmed control instruction, and the ZIGBEE transceiving unit transmits the programmed control instruction to the stage lighting sets, according to the high-speed wireless transfer protocol to adjust lighting effect of the stage lighting sets.

5. The system according to claim 4, wherein the interference reduce and light adjustment unit comprises a data receiving unit, a micro processing unit, a pulse width modulation unit, an insulated gate driver protection unit, an insulated gate voltage adjusting unit and a filter unit, the data receiving unit receives a light adjustment signal, transmits the signal to the micro processing unit, the pulse width modulation unit is electrically connected to an output of the micro processing unit, the output of the micro processing unit is electrically connected to an input of the insulated gate driver input protection unit, the output of the insulated gate drive protection unit is electrically connected to the input of the insulated gate voltage adjusting unit, the insulated gate voltage adjusting unit is electrically connected to an input of the filter unit, an output of the filter unit is electrically connected to stage lighting sets.

* * * * *